US005109774A

United States Patent [19]

Deffayet

[11] Patent Number: 5,109,774

[45] Date of Patent: May 5, 1992

[54] PENETRATIVE PROJECTILES

[75] Inventor: Jean Deffayet, Olivet, France

[73] Assignee: Thomson-Brandt Armements, Boulogne Billancourt, France

[21] Appl. No.: 699,601

[22] Filed: May 14, 1991

[30] Foreign Application Priority Data

May 18, 1990 [FR] France ..... 90 06246

[51] Int. Cl.[5] ..... F42B 12/06; F42B 25/00; F42B 10/56

[52] U.S. Cl. ..... 102/382; 102/364; 102/387; 102/393; 102/394; 102/489; 102/517

[58] Field of Search ..... 102/364, 382, 386, 387, 102/393, 394, 401, 489, 517, 703, 406, 411, 473

[56] References Cited

U.S. PATENT DOCUMENTS 3,774,540 11/1973 Burford et al. .
4,090,446 5/1978 Tomasetti .

FOREIGN PATENT DOCUMENTS 298494 1/1989 European Pat. Off. .
3049623 7/1982 Fed. Rep. of Germany .
618654 3/1927 France ..... 102/387
2373032 6/1978 France .
2416447 8/1979 France .
2601763 1/1988 France .
16210 of 1915 United Kingdom ..... 102/394
1364160 8/1974 United Kingdom .

*Primary Examiner*—Harold J. Tudor
*Attorney, Agent, or Firm*—Oblon, Spivak, McClelland, Maier & Neustadt

[57] ABSTRACT

Disclosed is a new type of penetrating projectile, the penetrating capacity of which is improved and more efficiently controlled, notably through a solution to the problems of obliquity. A projectile of this type has a front element forming the active part, fixedly joined to a tube. The tube has a closed end which contains a propellant charge for the propulsion of the element and an igniter for the charge, responding to the impact of the element on a target. In reaching the target, the projectile penetrates it slightly under the effect of the velocity and it is only at this instant, or slightly after it, that the penetration proper takes place. The penetration thus takes place without obliquity. This projectile can be used as an individual munition or sub-munition.

6 Claims, 3 Drawing Sheets

PENETRATIVE PROJECTILES

BACKGROUND OF THE INVENTION

1. Field of the Invention

The present invention relates to projectiles, such as arrows, designed to penetrate a target to varying depths. It also relates to munitions containing a plurality of these projectiles designed, for example. to be placed on board vectors such as missiles, rockets etc.

2. Description of the Prior Art

The European patent application No. 88110917.7, filed on behalf of Diehl GMBH & Co. discloses a munition of this type, designed more especially to neutralize concrete taxiway circuits, runways or roads. It has an set of arrows contained in a package provided with a parachute and a propellant charge. After the munition is dropped from a carrier, first of all the parachute opens out. Then, once the verticality of the package is accurate, the propellant charge is set off. Then, once the entire propellant charge is consumed, a second charge is ignited to expel the arrows from the package, in order to give them a velocity in addition to that of the package.

The principle implemented in the above-mentioned invention is therefore, as in the other presently known systems, that of communicating a high velocity to the arrows towards the target to obtain efficient penetration which, if necessary, may be limited by radial projecting features in the rear part of the arrows.

However, the expulsion, by gun effect, of a bundle of projectiles at high relative velocity generally leads to high degrees of obliquity, that are not compensated for at short ranges and are highly detrimental to penetration. Furthermore, as the obliquity is highly variable since it also depends to a great extent on the wind, it is almost impossible to obtain a precise penetration depth or to make it uniform, notably because of the nutational motion of the projectiles, the direction of which is clearly a random direction at the instant of impact. In the neutralization of relatively soft targets, such as taxiways or roads, there is then a risk that a large part of the arrows will penetrate too deeply, without leaving any projecting parts.

Moreover, the principle of expelling a plurality of projectiles at high velocity from one and the same munition has another drawback arising out of the fact that these munitions are generally dropped at low altitude. This leads to a concentration (in a zone of a few decimeters) of the impacts of the arrows of one and the same munition, and hence to a distribution in "bouquets" of non-uniform density. This characteristic results in an appreciable loss in efficiency, especially when the targets aimed at are other than aerodrome runways, taxiway circuits or roads.

SUMMARY OF THE INVENTION

An aim of the present invention, therefore, is to provide for a new type of penetrating projectile to overcome these drawbacks, in order to extend their field of use while at the same time, increasing their efficiency.

To this end, an object of the invention is a penetrative projectile including a front element forming the active part designed for penetration, fixedly joined to a tube, said tube has a closed end which contains a propellant charge for the propulsion of said front element, and an igniter for the firing of the charge, responding to the impact of the front element on a target, said projectile further including a parachute attached to the rear end of the tube, designed to reduce the velocity of said projectile and to make its longitudinal axis approach the vertical, wherein the igniter includes a delay means such that the propellant charge is fired when the velocity of the projectile becomes substantially null.

BRIEF DESCRIPTION OF THE DRAWINGS

The invention shall be understood more clearly from the following explanations and from the appended drawings, wherein.

In these figures, the same references have been used throughout to designate the same elements.

DETAILED DESCRIPTION OF THE INVENTION

Figure 1:
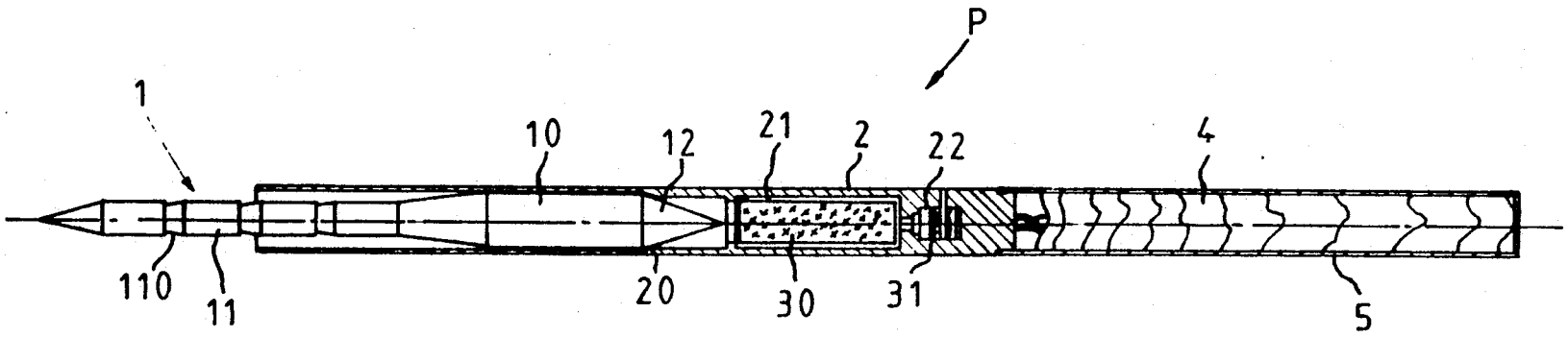
FIG. 1 shows a view in axial section of a projectile according to the invention.

The projectiles according to the invention have a front element 1, forming the active part, partially engaged in a rear part or tube 2. At least one intermediate part 10 of the element 1 is cylindrical and has the same caliber as the mouth of the tube 2, which has a retaining shoulder 20 behind this cylindrical part 10. In front of the part 20, the element 1 has a section that diminishes so as to have a pointed front part 11 that goes appreciably beyond the outlet of the tube 2.

Inside the tube 2, between the shoulder 20 and its closed rear end, there are successively a chamber 21 containing a propellant charge 30 and, communicating with the chamber 21, a housing 22 for an igniter 31 of the charge 30. The igniter 31 is designed to provide for the firing, with a delay, of the charge 30 in response to the encounter of the front element 1 with a target. In practice, this is preferably an igniter with inertial impact, provided with a delay means to bring about a very slight postponement (of some milliseconds for example) of the firing of the charge 30 with respect to the instant of impact. This delay is designed to enable the velocity of the projectile to get cancelled out or substantially cancelled out before the firing of the charge 30. It thus rids the projectile of the penetration stresses due to the non-null tangential component of its velocity in relation to the target. This phenomenon of obliquity, characterized by the angle of the velocity vector of the projectile with the axis of impact, in the present case the vertical axis, is one of the major reasons why the projectile does not penetrate the target.

The element 1 has certain special features as regards shape that vary according to the application for which the projectile is designed. In the embodiments shown in the drawings, the element 1 is an arrow for the neutralization of taxi-way circuits, runways or roads: it should penetrate only partially so as to let a pointed or sharp-edged part 12 jut out of the ground. To limit the depth of penetration, the caliber of the part 10 of the element 1 is substantially greater than that of the front part 11.

Thus, a braking by the part 10 is obtained and, when the movement comes to a stop, a partial penetration of this part 10 is obtained. This gives another advantage, namely that in the part 10, the arrow 1 is more difficult to section. Besides, in order to prevent the arrow from being extracted by being pulled out, or at least to make it more difficult to do so, an indentation 110, like that of a mountaineer's pegs, is advantageously provided on the front part 11.

If the element 1 has to penetrate totally into the target, if this target is a mine for example, the pointed terminal part 12 and the indentation 110 in the front part are then superfluous. As for the difference in calibers between the parts 10 and 11, although it is small, it will be generally kept so that the penetration depth is not excessive.

Figure 2:
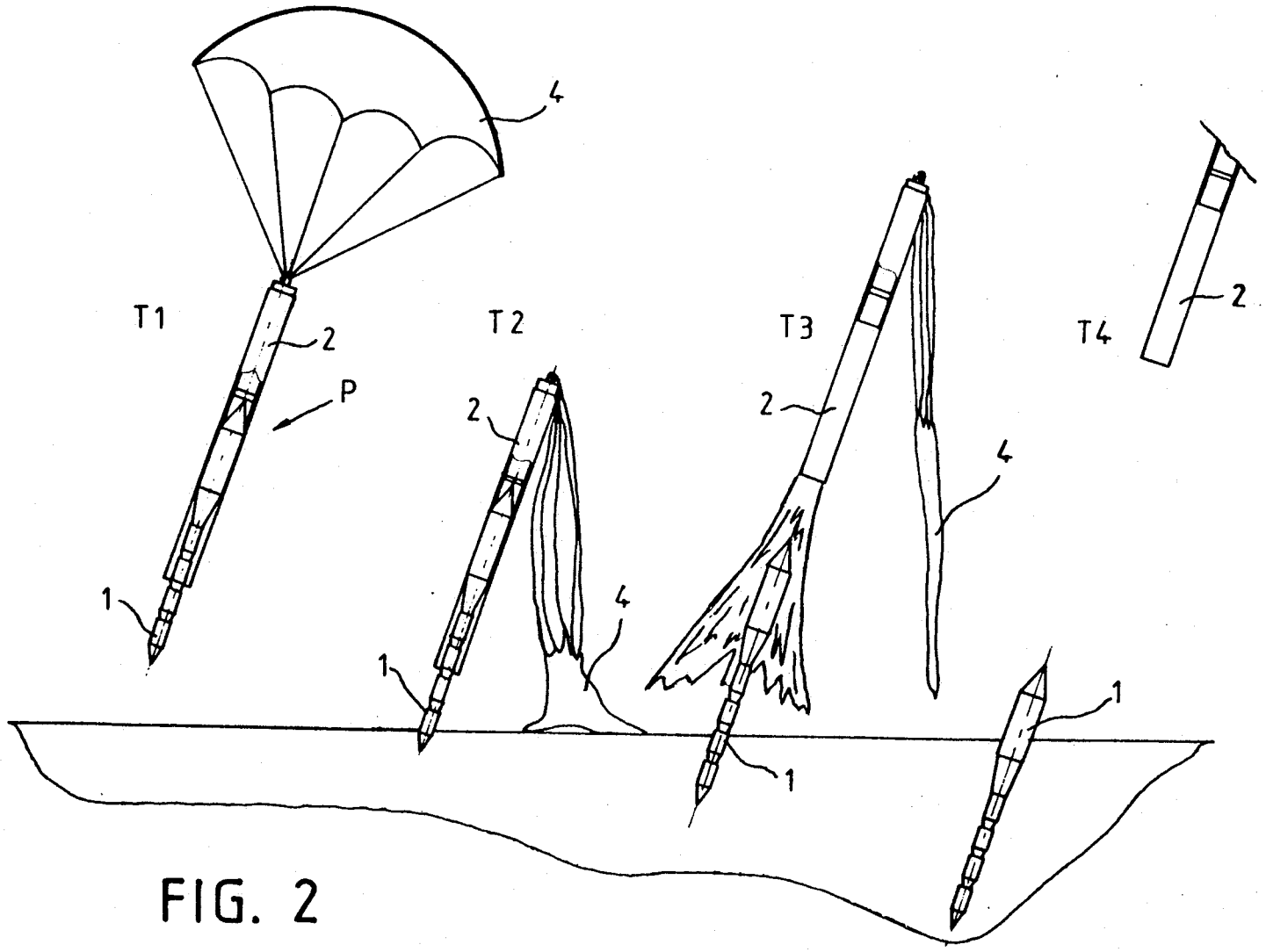
FIG. 2 is a view giving a schematic illustration of the working of the projectile of FIG. 1, in showing it at several successive instants.

FIG. 2 illustrates the general principle of operation of the projectiles according to the invention, although it shows the special embodiment of FIG. 1. At the instant T1, the projectile P reaches the vicinity of the target with a certain obliquity, and is suitably oriented by means such as a set of fins or, as in this case, a parachute. Its velocity is low but, owing to a high mass/section ratio to further the penetration, when the element 1 touches the target its tip 11 nevertheless penetrates to a small depth, and practically comes to a stop at the instant T2. At the instant T3, which follows the instant T2 by a few milliseconds (the delay of the impact igniter 31), the charge 30 is fired, generating a thrust that propels the element 1 more deeply with, in reaction, the expulsion of the tube 2 to a great distance from the element 1. This procedure makes it possible to get rid of the obliquity at impact and, consequently, to achieve greater control over the penetration of the element 1. It must also be noted that, for projectiles designed to penetrate the target completely, such as mines with seismic detonators, the discretion needed for this type of munition is not brought into question by the use of the principle of the invention since the tube 2, although it remains visible, is notably distant from the projectile itself during the penetration.

An additional advantage of the invention lies in the incendiary capacity of the projectiles when they penetrate containers of inflammable material (such as aircraft in hangars, fuel tanks, missiles, munitions etc.). When the rear tube 2 is ejected, hot gases under pressure escape at high velocity, accompanying the projectile in its progress. This effect may be boosted by appropriate incendiary additives in the propellant charges 30.

The projectile P according to the invention, as shown in FIG. 1, is designed to be ejected individually or in bundles from a carrier. As soon as it is ejected, therefore, it has an independent behavior and is consequently provided with a means to orient it appropriately with respect to the target. This means consists of a parachute 4 housed in a retractable package 5 fixed to the rear of the tube 2.

Figure 3:
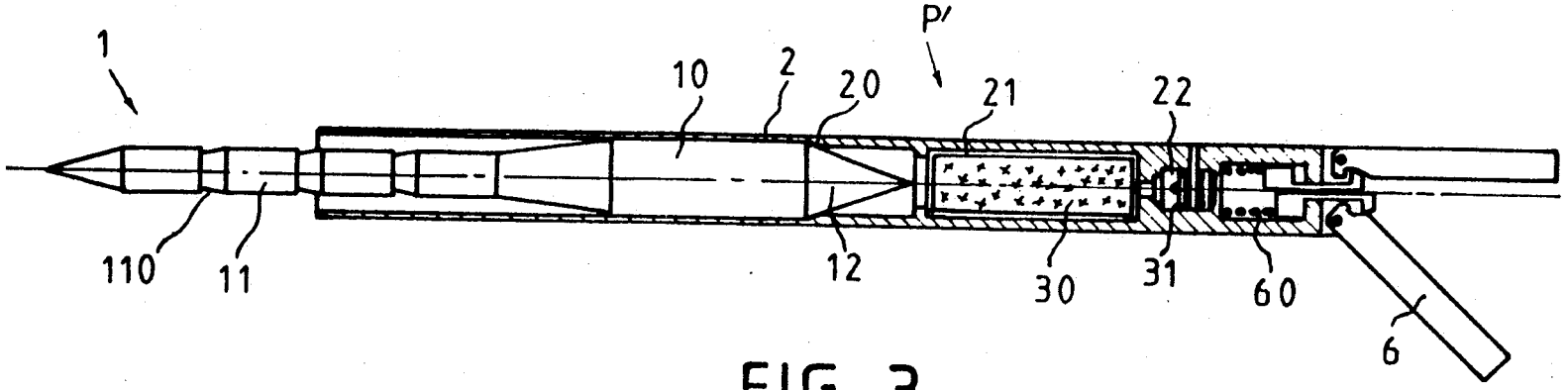
FIG. 3 shows a view in axial section of another projectile according to the invention, designed to be contained in numbers in a munition.
Figure 5:
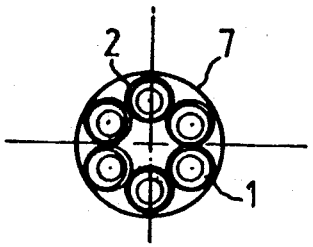
FIG. 5 shows a cross-sectional view along the line V—V of FIG. 4.
Figure 4:
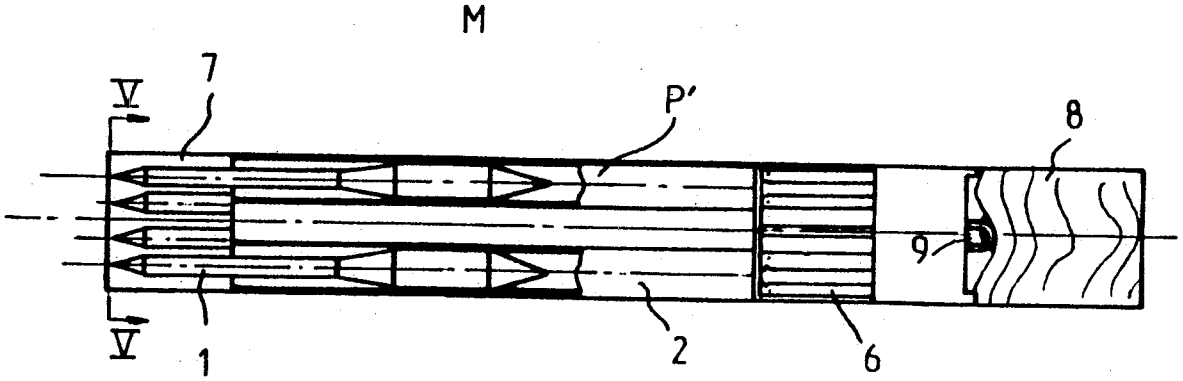
FIG. 4 shows a view in axial section of this munition.

The projectile P' of FIG. 3 is designed to form, with other identical projectiles, the active part of the munition M shown in FIGS. 4 and 5. It differs from the version of FIG. 2 inasmuch as, instead of a parachute, it has a set of several unfolding fins 6.

The munition M essentially has a container 7 in which there are several projectiles P', held side by side and pointed towards the outlet, a parachute 8 connected by a sprocket wheel 9 to the back of the container 7 opposite the outlet, and a chronometric sequencer to trigger the release of the projectiles at the end of a pre-determined time after they have been dropped, computed sufficiently for the munition M to come to an attitude close to the vertical and a certain velocity (of the order of 40 m/s). The projectiles leave the container 7 by gravity, hence without any great relative velocity, by the opening of the container 7 or by the withdrawal of a mechanical retaining piece. From the instant of exit onwards, the fins of the projectiles P' are unfolded, for example, by a spring means 60 kept in a coiled state within the container 7.

In order to distribute the projectiles, the container 7 has means (not shown) for being made to rotate on itself. These are, for example, aerodynamic means such as unfolding fins. If the rotational speed is 10 rps at the instant when the container 7 opens, the tangential velocity of the projectiles is close to 1.5 m/s in assuming that their center of gravity is about 24 mm from the axis. For an altitude of 40 m, and an axial velocity which, it will be recalled, is in the region of 40 m/s, we may hope for a distribution on the ground within a circle with a diameter:

$$2\times1.5/40\times40=3\text{ m}$$

With presently used munitions, where the velocity of expulsion is far greater, i.e. at least 200 m/s the same rotational speed of 10 rps and the same altitude of 40 m result in a diameter of dispersal of only 0.6 m. Now, it is known that, with these known munitions, the obliquity already raises a problem and it would not be wise to aggravate the problem by increasing the rotational speed. Consequently, as compared with known systems, the munition of the invention gives a considerably improved distribution of the projectiles P'.

In practice, munitions such as the munition M of FIGS. 4 and 5 are perfectly suitable for being fitted into large carriers provided with sophisticated ejection devices enabling controlled dispersal adapted to the target whereas, the individual projectile version illustrated in FIG. 1 is suited more to small carriers designed for smaller surface areas.

Naturally, the invention is not restricted to the above-described examples and it may be adapted, for example, to the improvement of existing weapons systems. In one of these systems, a rocket type carrier projectile contains sub-projectiles in the form of arrows, arranged with a single orientation (the head towards the front and the fins towards the rear of the rocket). Propulsion means provide for the ejection of the sub-projectiles along the path of the rocket, after its warhead has itself been expelled. One major drawback of these munitions is that their practical range is limited by the terminal kinetic energy needed for the accurate penetration of the sub-projectiles. Thus, at distances of about 2,000 m, the velocities of impact are of the order of 700 m/s while, beyond 4,000 m, they drop to below 300 m/s. The kinetic energies vary in a ratio of the order of 5, and vary to a far greater extent if an even higher range is sought. The use of finned sub-projectiles, according to the invention to fit out these rockets is one way of increasing the range or else of increasing the penetration.

What is claimed is:

1. A penetrating projectile, comprising:

a front penetrating element;

a tube fixedly joined to said front element contained therein, said tube having a first open end for receiving said front element and a second closed end, said closed end containing a propellant charge for the propulsion of said front element, and said tube further containing an igniter means for controlling the firing of the charge upon impact of the front element on a target, said projectile further including a parachute attached to said closed end of the tube, for reducing the velocity of said projectile and to make its longitudinal axis approach the vertical, said igniter means including a delay means for firing said propellant charge when the velocity of the projectile becomes substantially null.

2. A projectile according to claim 1, wherein the front element includes a front pointed part with a first maximum diameter and a non-deformable part having a greater diameter than said first maximum diameter in order to limit the penetration and prevent the destruction of the front element.

3. A projectile according to claim 1, wherein the charge includes incendiary additives.

4. A projectile according to claim 1, wherein the front element is an arrow.

5. A projectile according to claim 1, wherein the rear part of the element is pointed or sharp.

6. A projectile according to claim 4 or 5, wherein the front part of the element includes an indentation to prevent it from being extracted.

* * * * *